US007874660B2

(12) United States Patent
Haines et al.

(10) Patent No.: US 7,874,660 B2
(45) Date of Patent: Jan. 25, 2011

(54) CLOSURE AND CONNECTOR FOR A SUPPLY CONTAINER

(75) Inventors: Paul Mark Haines, Corvallis, OR (US); David M. Hagen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 549 days.

(21) Appl. No.: 11/869,840

(22) Filed: Oct. 10, 2007

(65) Prior Publication Data

US 2009/0096836 A1 Apr. 16, 2009

(51) Int. Cl.
*B41J 2/175* (2006.01)
*B65D 53/00* (2006.01)
*B65D 51/20* (2006.01)

(52) U.S. Cl. ..... 347/86; 347/85; 220/233; 220/361

(58) Field of Classification Search ..... None
See application file for complete search history.

(56) References Cited

U.S. PATENT DOCUMENTS 4,089,432 A * 5/1978 Crankshaw et al. ..... 215/6
5,970,273 A 10/1999 Zenk et al.
6,386,675 B2 5/2002 Wilson et al.
6,471,333 B1 10/2002 Powell et al.
6,585,359 B1 7/2003 Gasvoda et al.
7,234,787 B2 6/2007 Grady et al.
2002/0024571 A1 * 2/2002 Childers et al. ..... 347/85
2002/0158943 A1 10/2002 Powell et al.

FOREIGN PATENT DOCUMENTS

JP 10044462 A 2/1998
JP 2002113881 A 4/2002

* cited by examiner

*Primary Examiner*—Omar Rojas

(57) ABSTRACT

In one embodiment a closure for a supply container includes: a spout affixed to the container; a plug configured to plug the spout in a partially inserted position from which the plug may be easily removed from the spout and to plug the spout in a fully inserted position from which the plug may not be easily removed from the spout; an opening in the plug through which material in the container may flow when the plug is inserted into the spout; and a breachable seal sealing the opening.

21 Claims, 11 Drawing Sheets

CLOSURE AND CONNECTOR FOR A SUPPLY CONTAINER

BACKGROUND

Some high production inkjet printers utilize very large off-axis ink supplies. Each supply container may hold several liters of ink. Such large ink supplies present special challenges in the development of closure and connection systems that combine a secure closure with a large ink fill port and still provide a reasonable degree of ease and reliability when installing the container at the printer supply station.

DRAWINGS

DESCRIPTION

Embodiments of the present disclosure were developed in an effort to improve closure and connection systems for very large ink supplies. Exemplary embodiments of the disclosure will be described, therefore, with reference to an ink supply container and an inkjet printer ink supply station that supports large ink supply containers. Embodiments of the disclosure, however, are not limited to the exemplary embodiments shown and described below. Other forms, details, and embodiments may be made and implemented. Hence, the following description should not be construed to limit the scope of the disclosure, which is defined in the claims that follow the description.

As used in this document: a "chip" means an integrated or other electronic circuit that may be used to store information; a "lip" means a projecting edge; a "plug" means something used to fill a hole; a "septum" means a membrane that seals around a needle inserted through the membrane; and a "spout" means a short projecting tube or lip through which a liquid or other material may flow from a container.

Figure 1:
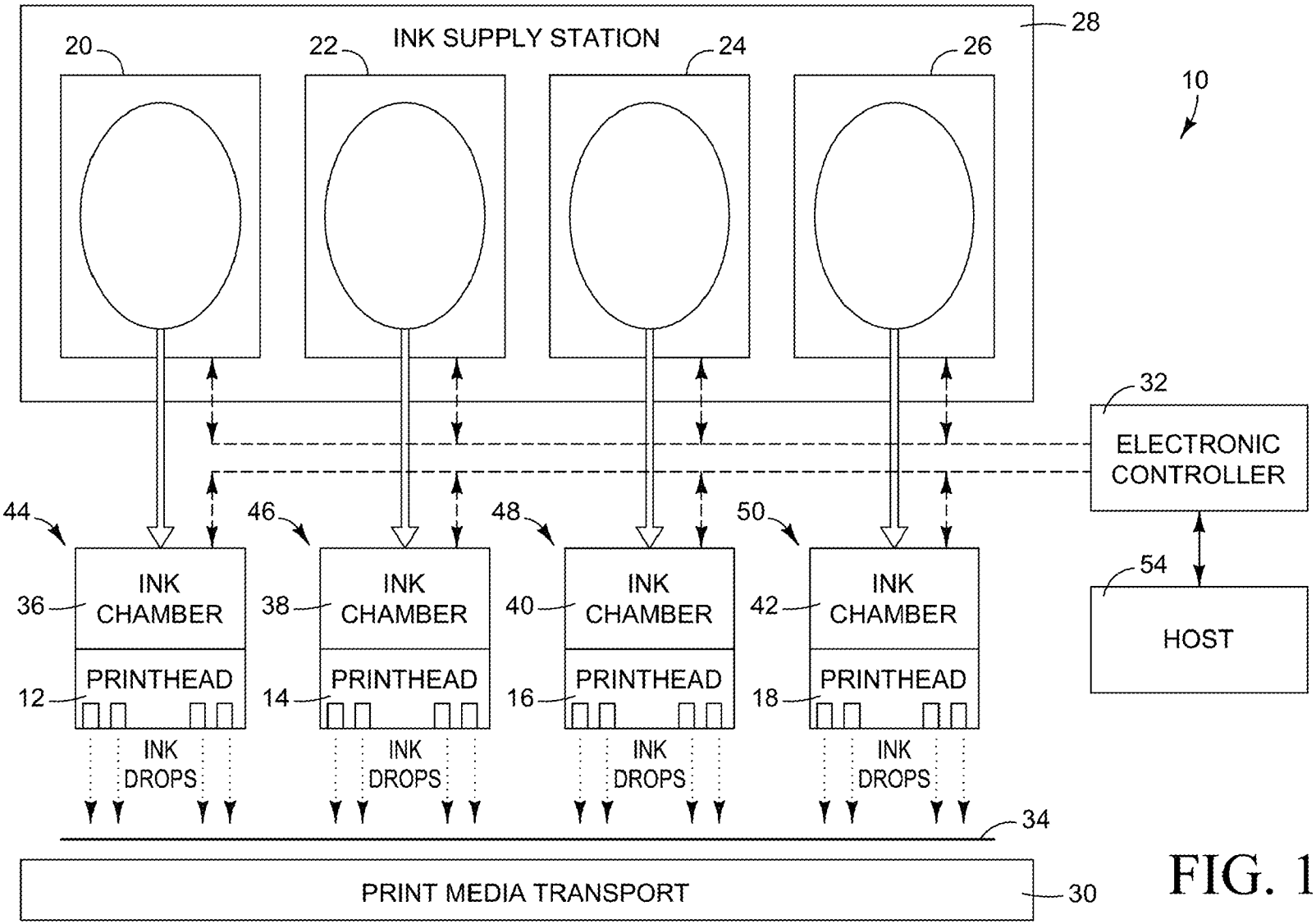
FIG. 1 is a block diagram illustrating an inkjet printer.

FIG. 1 is a block diagram illustrating an inkjet printer 10 in which embodiments of the invention may be utilized. Referring to FIG. 1, inkjet printer 10 includes a series of printheads 12, 14, 16, and 18, a series of corresponding ink supplies 20, 22, 24, and 26 at a supply station 28, a print media transport mechanism 30, and an electronic printer controller 32. Each printhead 12-18 and the corresponding ink supply 20-26 is usually associated with a different color ink. Each printhead 12-18 in FIG. 1 represents generally one or more printheads and the associated mechanical and electrical components for ejecting drops of ink on to a sheet or strip of print media 34. For example, a typical thermal inkjet printhead includes a nozzle plate arrayed with ink ejection nozzles and firing resistors formed on an integrated circuit chip positioned behind the ink ejection nozzles. Each printhead 12-18 is electronically coupled to printer controller 32 and fluidically coupled to the corresponding ink supply 20-26. In operation, printer controller 32 selectively energizes the firing resistors and, when a firing resistor is energized, a vapor bubble forms in the ink vaporization chamber, ejecting a drop of ink through a nozzle on to the print media 34. In a piezoelectric printhead, for another example, piezoelectric elements are used to eject ink from a nozzle. Piezoelectric elements located close to the nozzles are caused to deform very rapidly to eject ink through the nozzles.

An ink chamber 36, 38, 40, and 42 and a printhead 12-18 are often housed together in an ink pen 44, 46, 48, and 50. Ink pens are sometimes also referred to as print cartridges, ink cartridges or printhead assemblies. Printer 10 may include a series of stationary ink pens 44-50 that span the width of print media 34 or a series of scanning ink pens 44-50 that are scanned back and forth across the width of media 34 on a moveable carriage. Media transport 30 advances print media 34 past printheads 12-18. For stationary pens 44-50, media transport 30 may advance media 34 continuously past printheads 12-18. For scanning pens 44-50, media transport 30 may advance media 34 incrementally past pens 44-50, stopping as each swath is printed and then advancing media 34 for printing the next swath. Ink flows to a printhead 12-18 in pens 44-50 from an ink supply 20-26 through an ink chamber 36-42. Each ink chamber 36-42 represents generally one or more ink chambers in the pen through which ink passes on its way to the printhead. For example, the ink may pass through a filter chamber and a pressure regulator chamber before reaching the printhead.

Ink may be supplied to each pen 44-50 from a supply 20-26 using any suitable technique. For example, ink may be pumped from supplies 20-26 to pens 44-50, ink may flow to pens 44-50 under the influence of gravity (i.e., gravity feed) or each ink supply 20-26 may be pressurized to feed the ink into each ink pen 44-50. Controller 32 receives print data from a computer or other host device 54 and processes that data into printer control information and image data. Controller 32 controls the movement of the carriage, if any, and media transport 34. As noted above, controller 32 is electrically coupled to printheads 12-18 to energize the firing resistors to eject ink drops on to media 34. By coordinating the relative position of pens 44-50 and media 34 with the ejection of ink drops, controller 32 produces the desired image on media 34 according to the print data received from host 54.

Figure 2:
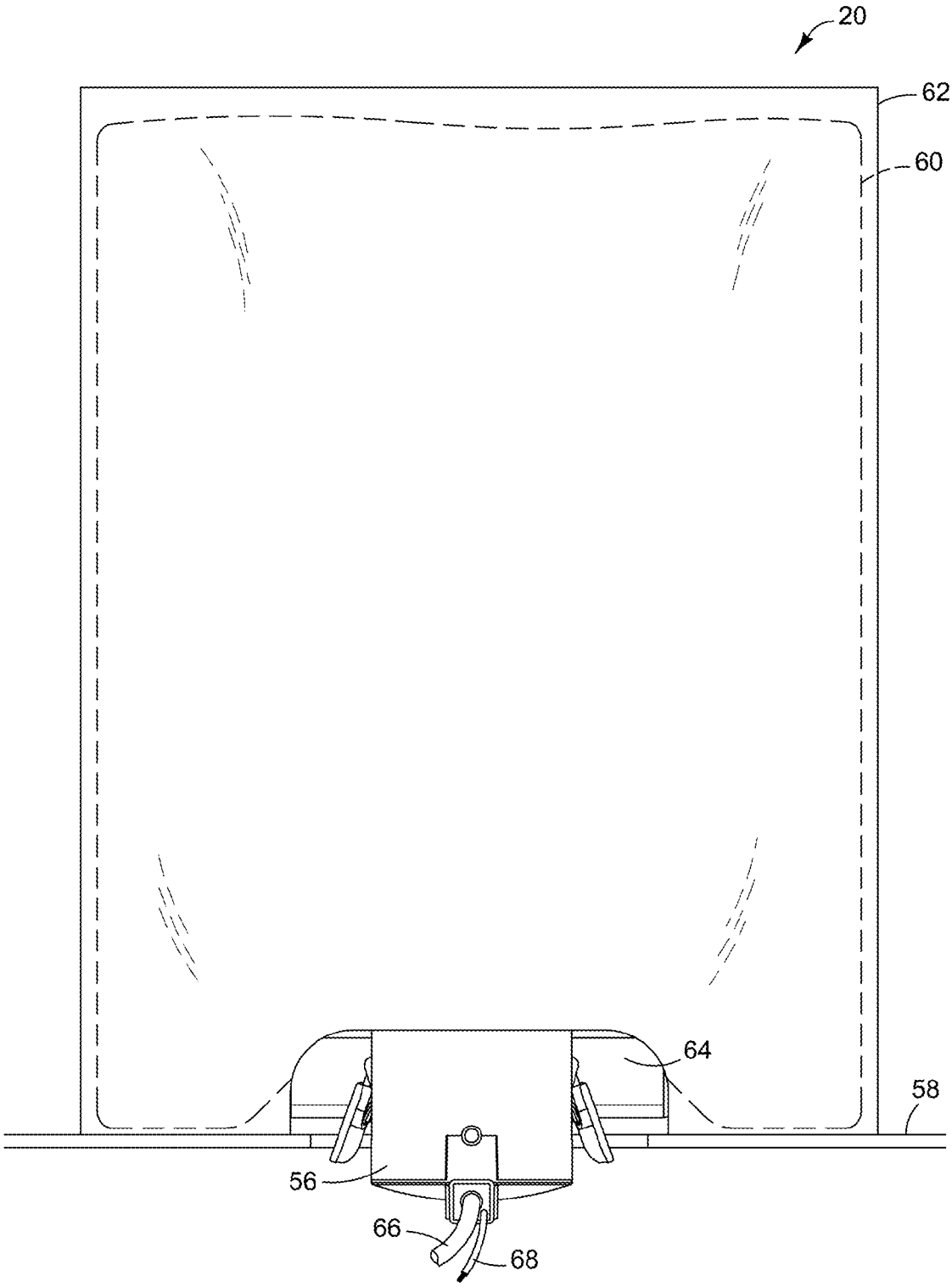
FIG. 2 is an elevation view of one embodiment of an ink supply installed in an ink supply station in an inkjet printer such as the printer shown in FIG. 1.
Figure 3:
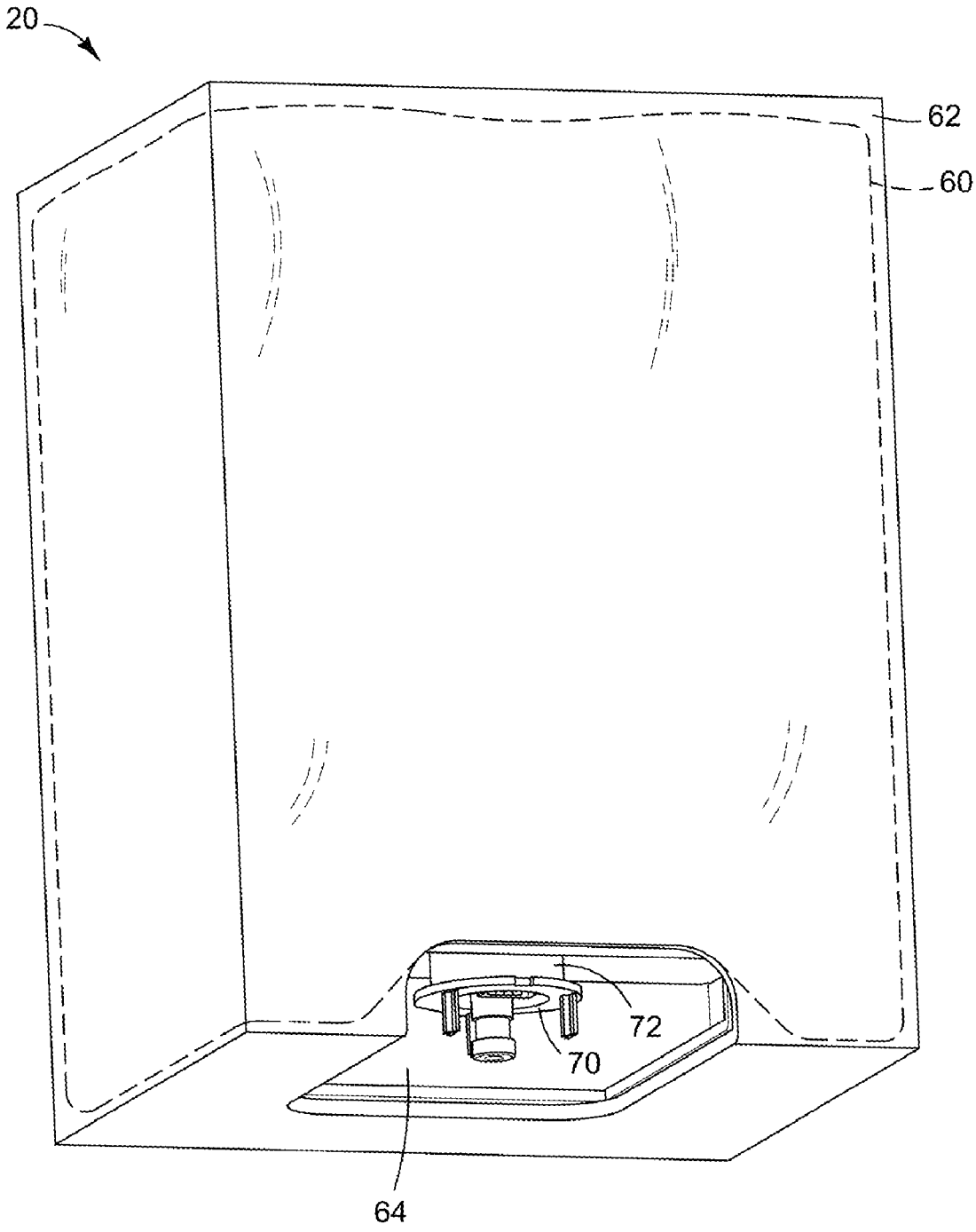
FIG. 3 is a perspective view of the ink supply shown in FIG. 2.

FIG. 2 is an elevation view of one embodiment of an ink supply 20 installed in a supply station 28 in an inkjet printer such as printer 10 shown in FIG. 1. FIG. 3 is a perspective view of ink supply 20. Referring first to FIG. 2, supply station 28 includes a receptable 56. As discussed in detail below, receptacle 56 provides the operative connection between ink supply 20 and ink pen 44 and between ink supply 20 and controller 32. Supply 20 is supported on a shelf 58 or other suitable structure at supply station 28. Referring now also to FIG. 3, in the embodiment shown, ink supply 20 includes a collapsible container 60 for holding ink. Container 60 is housed in a rigid box or other suitable housing 62. An opening 64 at the bottom of housing 62 allows user access to the outlet area of container 60 and to receptacle 56 to facilitate installing ink supply 20 at supply station 28. Ink flows from container 60 through receptacle 56 and tube 66 to ink pen 44. Electronic signals are transmitted between controller 32 and circuitry associated with supply 20 through receptacle 56 and a wire or signal trace bundle 68.

Figure 4:
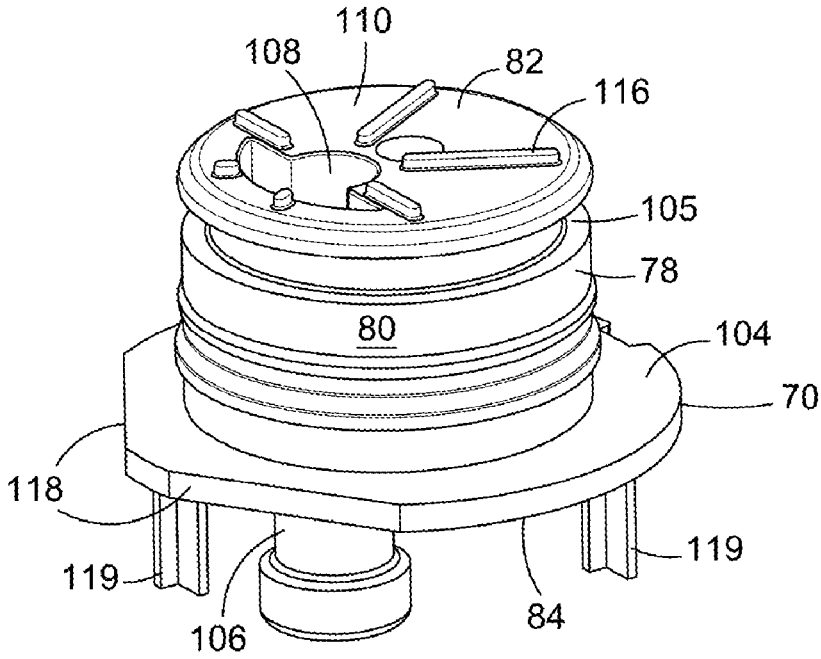
FIGS. 4 and 5 are perspective views of one embodiment of a plug for closing the ink supply container in the ink supply shown in FIGS. 2 and 3.
Figure 5:
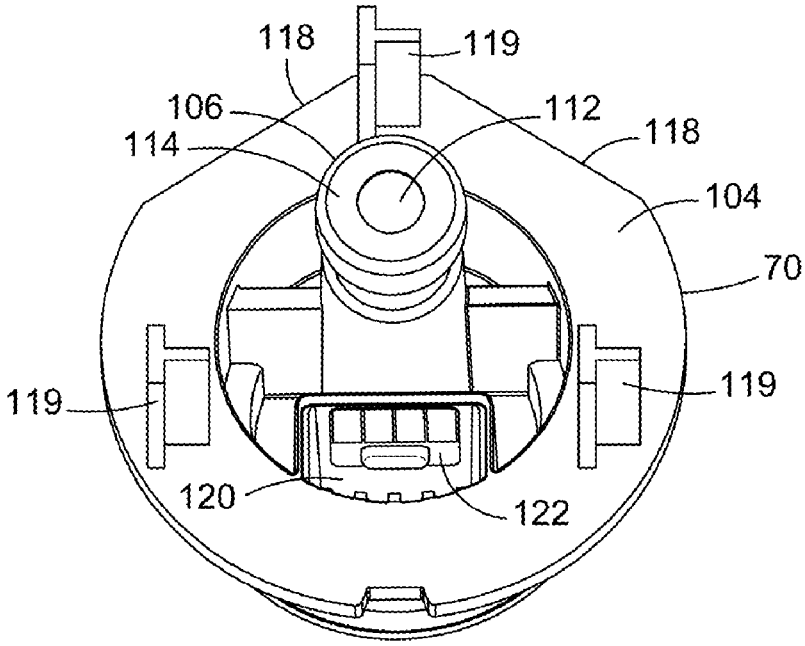
Figure 6:
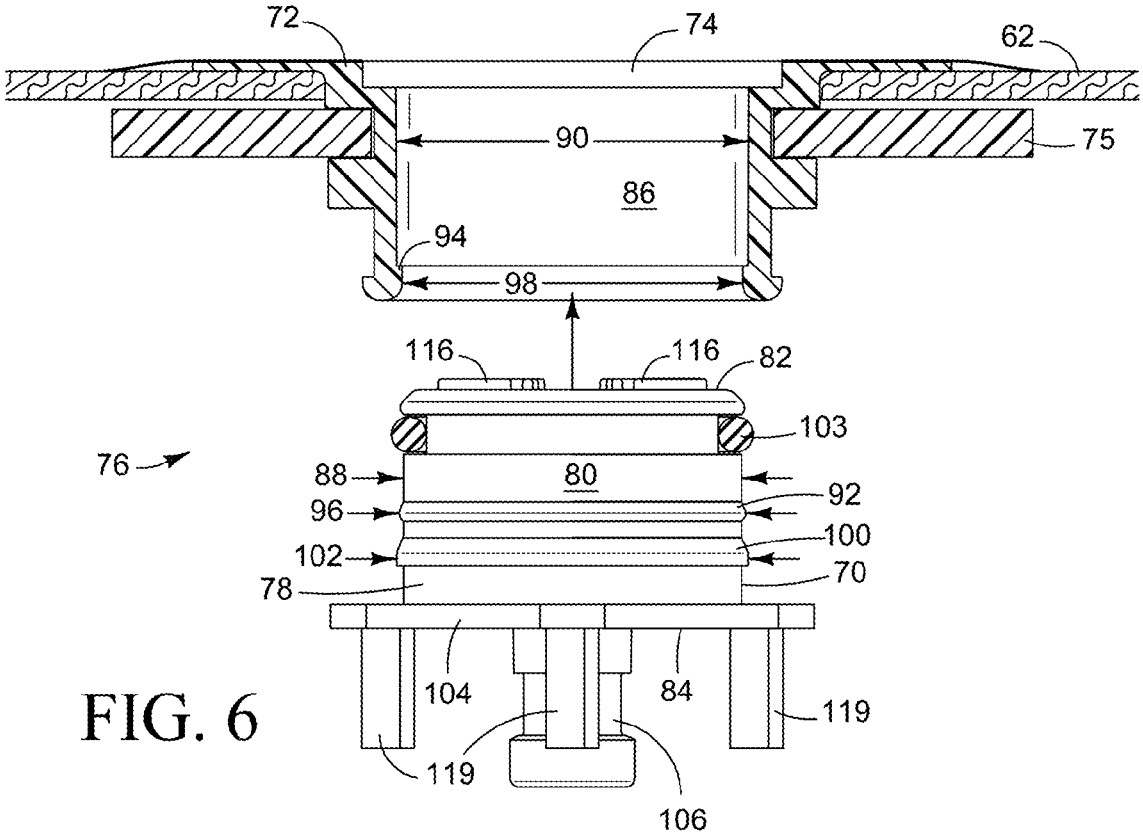
FIGS. 6-8 are a sequence of elevation and partial section views showing installation of the plug of FIGS. 4-5 in an ink supply container.
Figure 7:
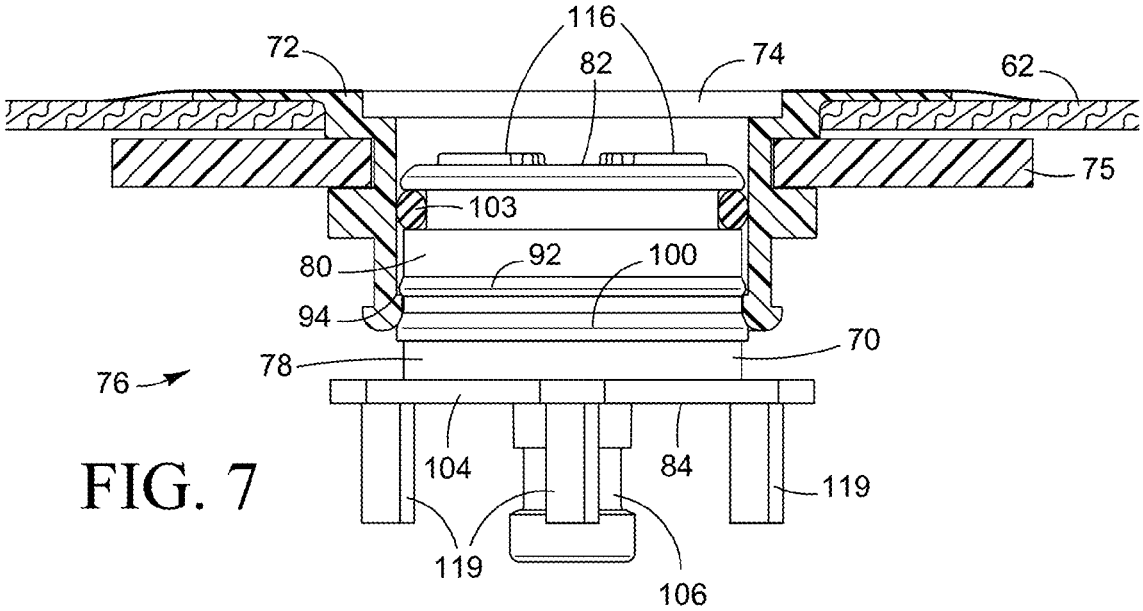
Figure 8:
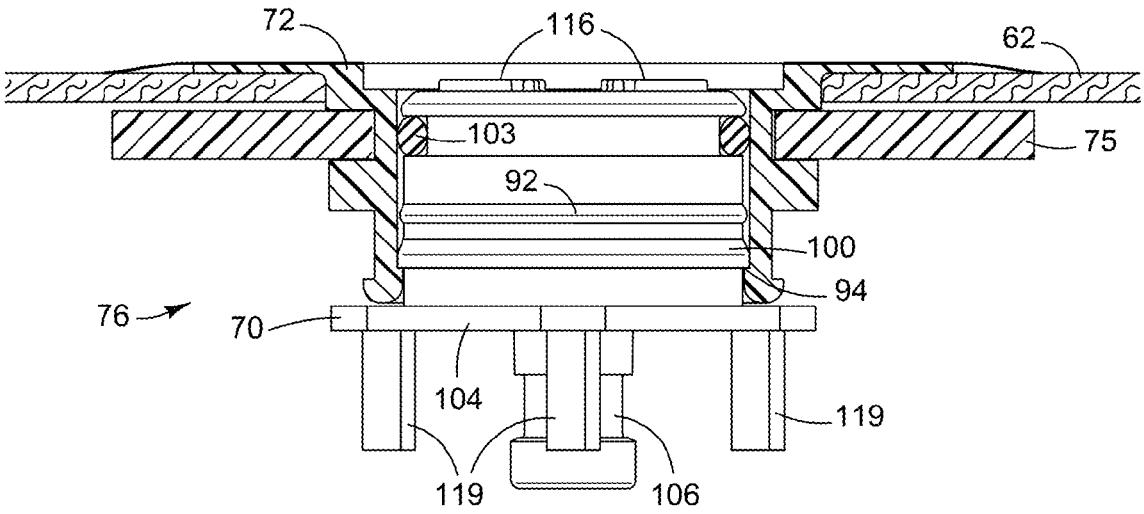

FIGS. 4 and 5 are perspective views of one embodiment of a plug 70 for closing ink container 60. FIGS. 6-8 are a sequence of elevation views showing installation of plug 70 in a spout 72 at the outlet 74 of container 60. A stiff retainer 75 may be used to help secure spout 72 in a box 62. Spout 72 and plug 70 form a closure 76 for container 60. Referring to FIGS. 4-8, plug 70 includes a cylindrical barrel 78 characterized by an outside surface 80, a leading end 82 facing the interior of container 60 when plug 70 is installed in spout 72, and a trailing end 84 that fits into receptacle 56. The directional characterization of a "leading" end and a "trailing" end is made with reference to inserting plug 70 into spout 72.

The outside surface 80 of plug barrel 78 conforms generally to the shape of the inside surface 86 of spout 72, as best seen in FIGS. 7 and 8. Plug outside surface 80 has a nominal outside diameter 88 that is slightly less than the nominal inside diameter 90 of spout inside surface 86. Still referring to FIGS. 4-8, a ridge 92 on plug outside surface 80 is sized and shaped to interfere with a lip 94 on spout inside surface 86 when plug 70 is inserted into and removed from spout 72 such that the interference between ridge 92 and lip 94 resists but does not prevent inserting plug 70 into spout 72 or removing plug 70 from spout 72. Hence, for example, ridge 92 transitions gradually on both its leading edge and its trailing edge from nominal outside diameter 88 out to a ridge diameter 96 that is greater than the inside diameter 98 of lip 94. A lip 100 on plug outside surface 80 is sized and shaped (1) to interfere with lip 94 on spout inside surface 86 to resist but not prevent inserting plug 70 into spout 72 and (2) to catch on lip 94 to prevent removing plug 70 from spout 72 once plug 70 is inserted fully into spout 72. Hence, for example, lip 100 transitions gradually on its leading edge and abruptly on its trailing edge from nominal outside diameter 88 out to a lip diameter 102 that is greater than inside diameter 98 of lip 94.

Ridge 92 is positioned forward of lip 100, toward leading end 82, on plug barrel outside surface 80. Thus, and referring specifically to FIGS. 6 and 7, as plug 70 is inserted into spout 72, ridge 92 is the first to engage lip 94 to secure plug 70 in the position shown in FIG. 7 partially inserted into spout 72. In the embodiment shown, ridge 92 and lip 100 on plug 70 are spaced apart from one another a distance that approximates the width of lip 94 on spout 72. This spacing helps plug 70 fit more tightly in spout 70 in the partially inserted position shown in FIG. 7. This position allows container 60 to be temporarily closed, for example during "dry" shipping and handling before container 60 is filled with ink. Then, once container 60 is filled with ink and plug 70 is inserted fully into spout 72, the abrupt trailing edge of plug lip 100 catches on spout lip 94 to prevent removing plug 70, as shown in FIG. 8. In the embodiment shown, lip 100 on plug 70 and flange 104 on the trailing end 84 of plug 70 are spaced apart from one another a distance that closely approximates the width of lip 94 on spout 72. This spacing helps plug 70 fit tightly in spout 70 in the fully inserted position shown in FIG. 8. An O-ring 103 (FIGS. 6-8) positioned in a slot 105 (FIG. 4) around outside surface 80 near leading end 82, or another suitable seal, seals against ink leaking from container 60 past plug 70.

Referring again to FIGS. 4-8, a conduit 106 extends from an opening 108 at a leading end face 110 of plug 70 to a breachable seal 112 on the projecting end 114 of conduit 106 at plug trailing end 84. Such a breachable seal 112 in an ink supply is often formed as a septum. Ridges 116 on plug face 110 radiating out from opening 108 help prevent container 60 from collapsing on to and closing opening 108 as ink is withdrawn from container 60. Referring to FIGS. 4 and 5, a pair of straight/flat parts 118 on the perimeter of flange 104 serves as a first keying feature that, along with mating flat parts on receptacle 56 (described below), help the user identified the correct alignment between plug 70 and receptacle 56. T-posts 119 projecting out from flange 104 at plug trailing end 84 serve as a second keying feature that, along with T-shaped holes in receptacle 56 (described below), help prevent the user from inadvertently installing the wrong ink supply 20-26 into a receptacle 56. A pocket 120 houses a chip 122 that may identify various features or status of ink supply 20 to controller 32 when supply 20 is installed in receptacle 56.

Figure 9:
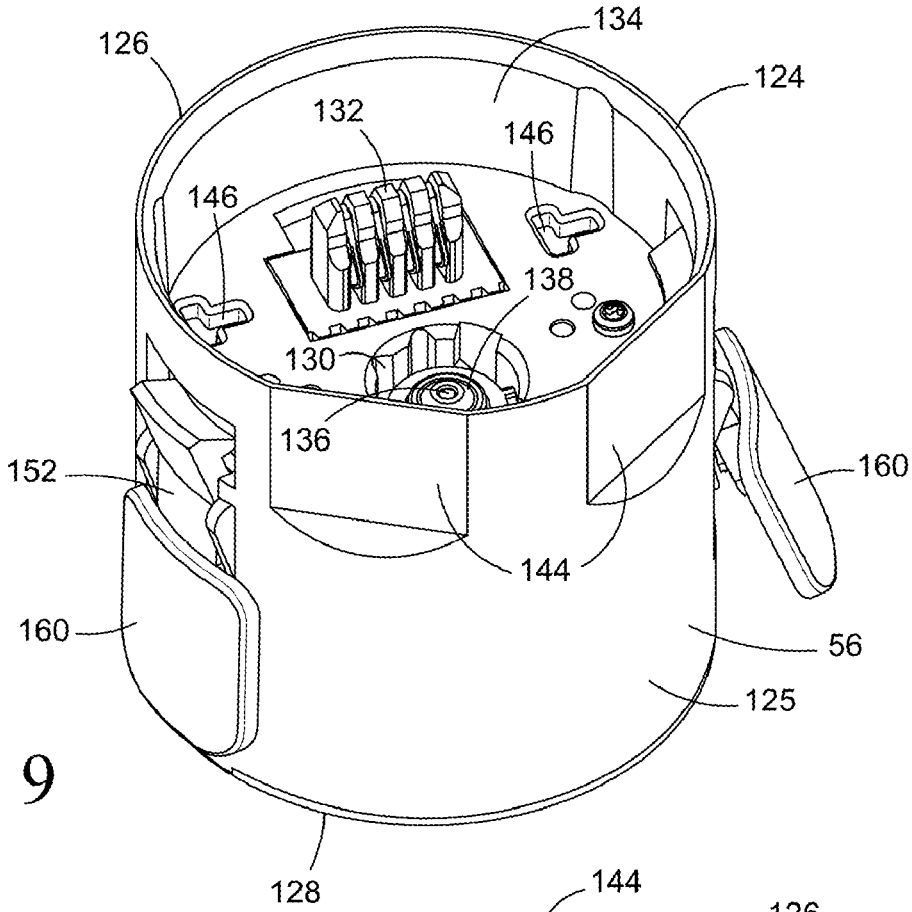
FIGS. 9-11 are perspective views of one embodiment of a receptacle for receiving the plug of FIGS. 4-5 to connect the ink supply container to the printer.
Figure 10:
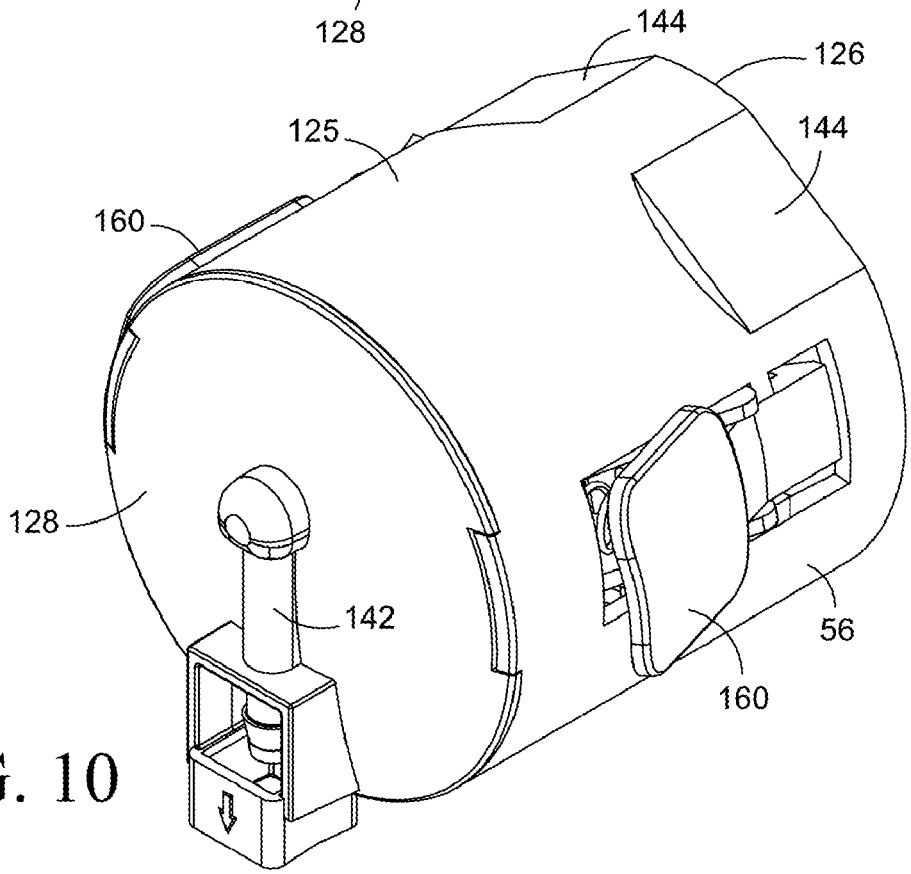
Figure 11:
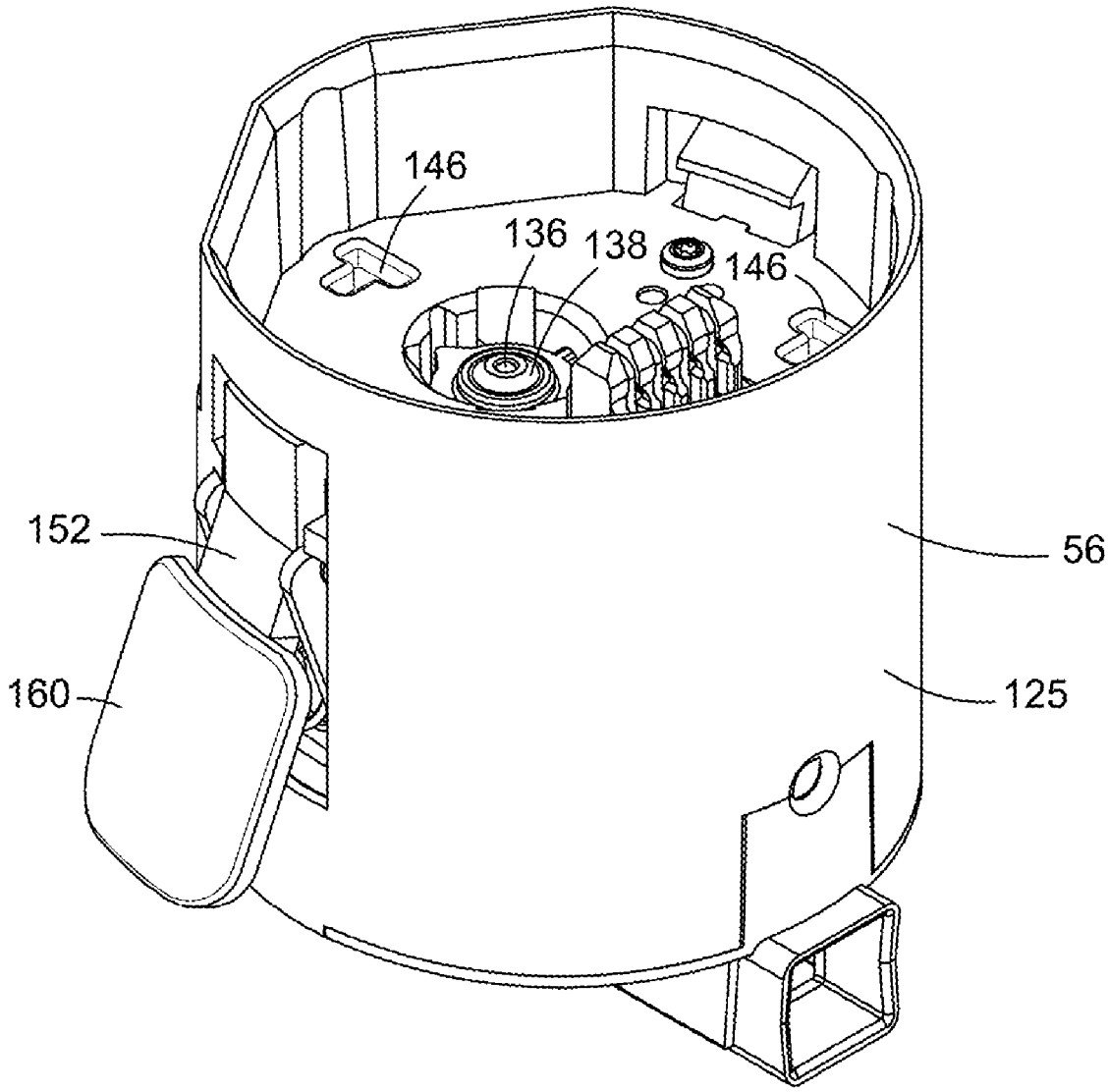
Figure 12:
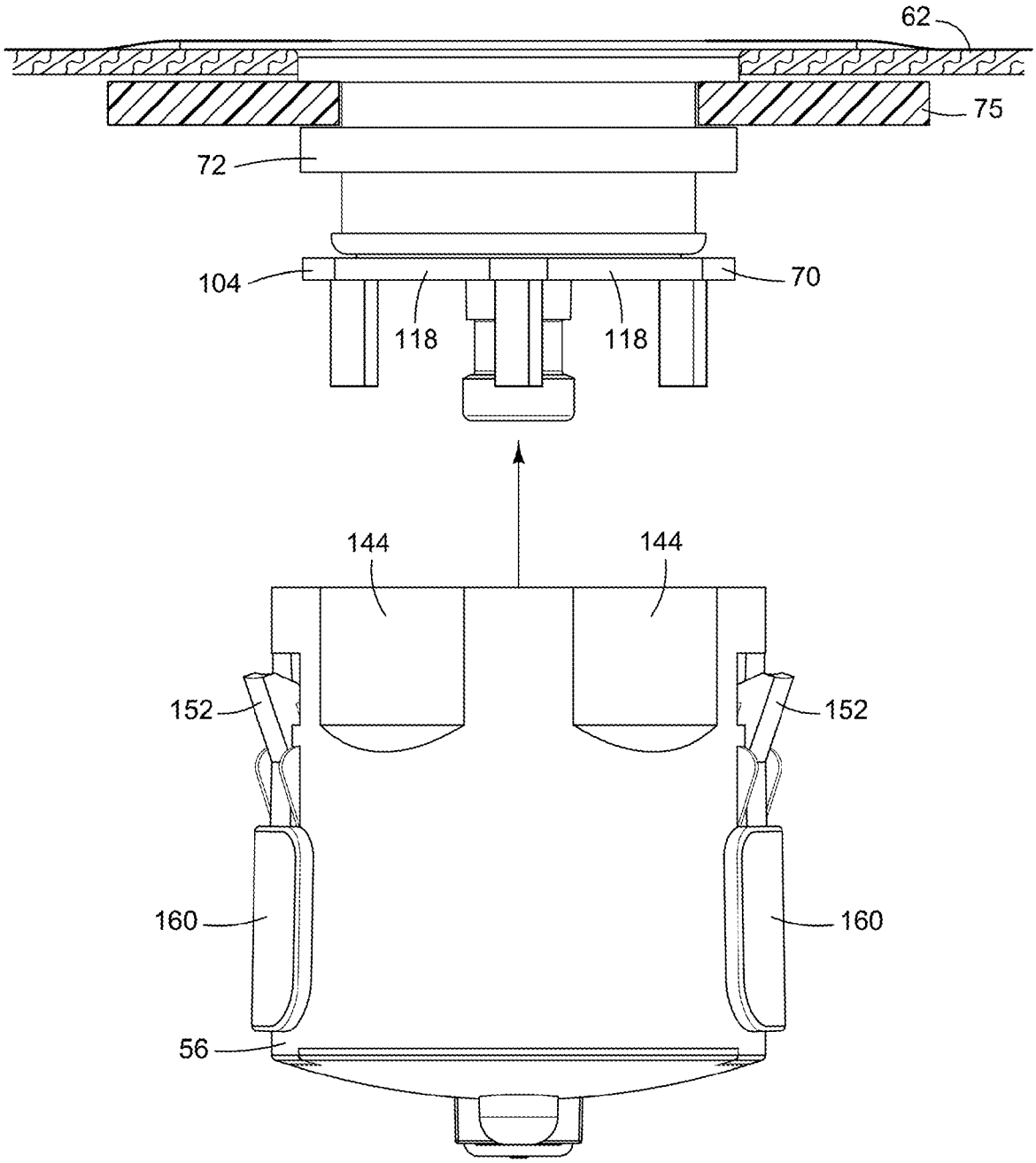
FIGS. 12 and 13 are a sequence of elevation views showing installation of the plug of FIGS. 4-5 into the receptacle of FIGS. 9-11.
Figure 13:
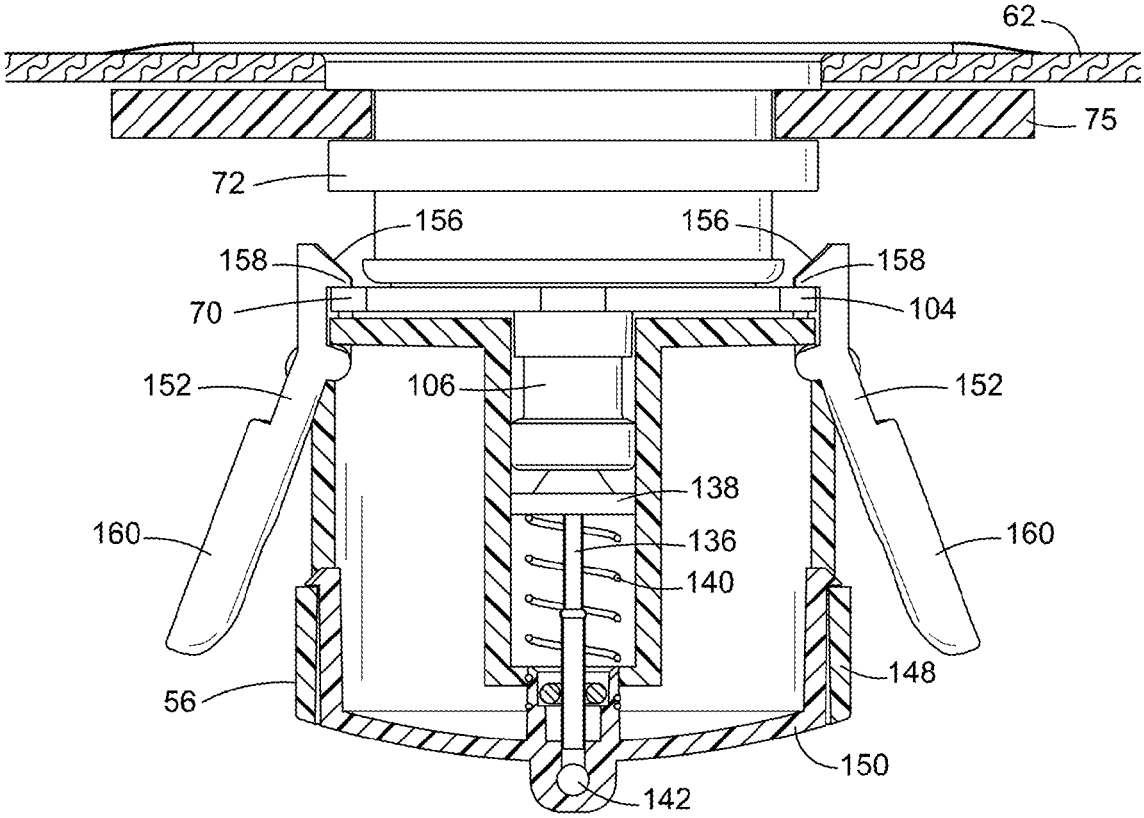

FIGS. 9-11 are perspective views of one embodiment of a receptacle 56 for receiving trailing end 84 of plug 70. FIGS. 12 and 13 are a sequence of elevation views showing the installation of plug 70 in receptacle 56. Some parts of receptacle 56 are shown in section in FIG. 13 to better illustrate plug 70 installed in receptacle 56. Referring to FIGS. 9-13, receptacle 56 includes a housing 125 that has a leading end 126 for receiving plug 70 and a trailing end 128. The directional characterization of a "leading" end and a "trailing" end for receptacle 56 is made with reference to installing receptacle 56 on to plug 70. Thus, the leading end 126 of receptacle 56 plugs on to and receives the trailing end 84 of plug 70. An ink port 130 and electrical contacts 132 are positioned in a recess 134 in housing 125 at receptacle leading end 126.

Ink port 130 includes a needle 136 and a protective humidor 138 surrounding needle 136. A humidor 138 is commonly used to help keep the opening in needle 136 from drying out or crusting up when not inserted in septum 112. Humidor 138 is biased toward the protective position shown in FIG. 11 at the urging of a biasing spring 140 (FIG. 13). As plug trailing end 84 is received into recess 134, conduit end 114 and septum 112 on plug 70 push down on humidor 138, compressing spring 140, and exposing the end of needle 136 until, upon full insertion, needle 136 pierces septum 112 so that ink can flow from container 60, through needle 136, to an outlet conduit 142 and on to an ink pen through tube 66. The protruding electrical contacts 132 on receptacle 56 contact chip 122 in plug pocket 120 to connect chip 122 to printer controller 32 through signal traces 68.

Figure 14:
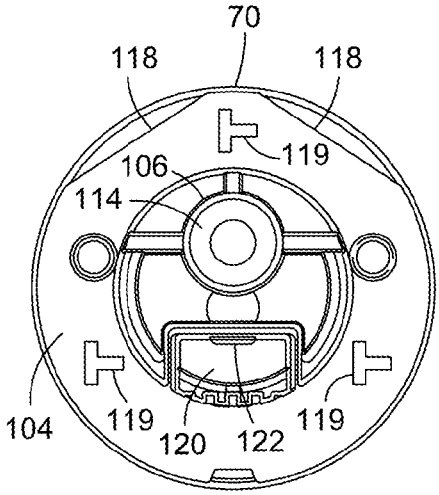
FIGS. 14-15 and 16-17 show the different keying features for two ink supplies, respectively.
Figure 15:
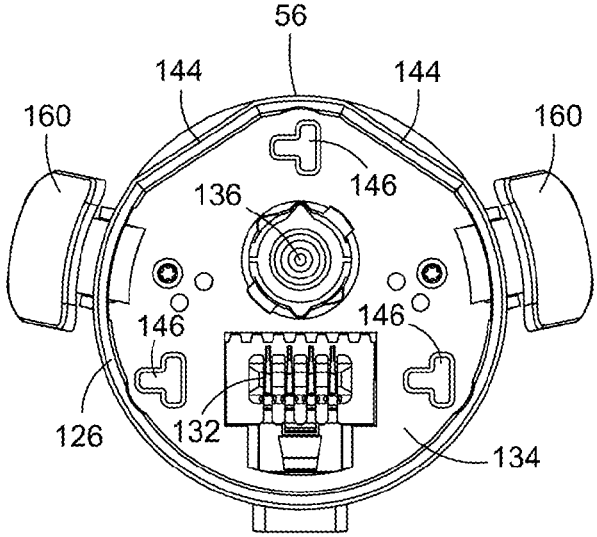
Figure 16:
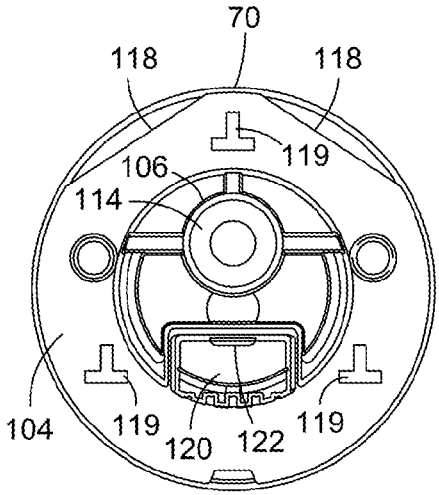
Figure 17:
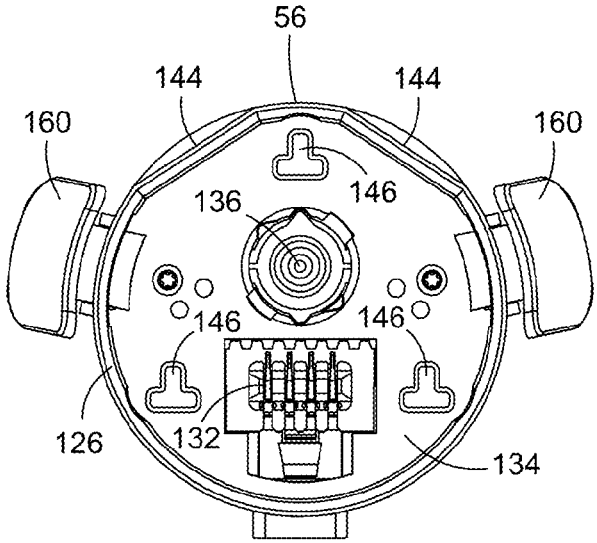

A pair of straight/flat parts 144 on the perimeter of housing 125 at leading end 126 serves as a first keying feature that, along with mating flat parts 118 on plug flange 104, help the user identify the correct alignment between plug 70 and receptacle 56. T-shaped holes 146 at the bottom of recess 134 serve as a second keying feature that, along with T-posts 119 projecting out from plug flange 104, help prevent the user from inadvertently installing the wrong ink supply 20-26 into a receptacle 56. For example, the number, position and/or orientation of T-posts 119 and T-holes 146 may be different for each color ink supply 20-26 so that a user cannot install a black ink supply, for example, into a yellow ink supply receptacle. The number, position and/or orientation of each of the three T-posts 119 and mating T-holes 146 can be changed to accommodate many different color/ink combinations. For example, the orientation of T-posts 119 and T-holes 146 may be rotated 90° to designate two different color ink supplies, as seen by comparing the orientation of T-posts 119 and T-holes 146 in FIGS. 14-15 with the orientation of T-posts 119 and T-holes 146 in FIGS. 16-17.

Receptacle housing 125 may include a body 148 and an end cap 150 affixed to body 148 as shown in FIG. 13. Alternatively, housing 125 may be formed as a single unit or as two or more units as may be necessary or desirable to facilitate efficient fabrication and assembly. A pair of pivoting, spring loaded latches 152 secure receptacle 56 on plug 70. A spring (not shown) or other suitable biasing mechanism urges each latch 152 toward the closed position shown in FIG. 13. A beveled surface 156 approaches a catch 158 on the end of each latch 152. As receptacle 56 is pushed on to plug 70, plug flange 104 engages the beveled surfaces 156 to force each latch 152 open until catch 158 pops over flange 104 to latch receptacle 56 on to plug 70, as shown in FIG. 13. Pressing in on latch levers 160 releases catches 158, allowing receptacle 56 to be withdrawn from plug 70. (One of the latch levers 160 is shown in the depressed position with latch 152 open in FIG. 9 and the other in the released/non-depressed position with latch 152 closed to better illustrate the two positions for latches 152.)

As noted at the beginning of this Description, the exemplary embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A closure for a supply container, comprising:

a spout affixed to the container;

a plug configured to plug the spout in a partially inserted position at which the plug cooperates with the spout to provide a first degree of resistance against removal of the plug from the spout and to plug the spout in a fully inserted position at which the plug cooperates with the spout to provide a second degree of resistance against removal of the plug from the spout greater than the first degree of resistance;

an opening in the plug through which material in the container may flow when the plug is inserted into the spout; and a breachable seal sealing the opening;

wherein the plug includes a leading end and a trailing end relative to an insertion direction of the plug into the spout, and the plug further comprises:

a first keying feature on the trailing end of the plug corresponding to a first keying feature in a receptacle for receiving the trailing end of the plug, the first keying feature configured to correctly align the plug with the receptacle; and a second keying feature on the trailing end of the plug corresponding to a second keying feature in the receptacle, the second keying feature configured to prevent the plug from being received in an incompatible receptacle.

2. The closure of claim 1, wherein the opening comprises a conduit extending lengthwise through the plug and the breachable seal seals a downstream end of the conduit.

3. The closure of claim 1, wherein the container comprises a collapsible container and the plug includes a spacer configured to prevent the container from collapsing on to and closing the opening.

4. The closure of claim 1, wherein the plug by includes a leading end and a trailing end relative to an insertion direction of the plug into the spout, and the plug further comprises a pocket in the trailing end of the plug configured to house a chip containing information about the container and/or material in the container.

5. The closure of claim 2, wherein the breachable seal comprises a septum.

6. The closure of claim 1, wherein the first keying feature comprises a plurality of T-shaped posts projecting out at the trailing end of the plug.

7. The closure of claim 3, wherein the spacer comprises a plurality of ridges near the opening on a face facing an interior of the container when the plug is inserted in the container.

8. The closure of claim 6, wherein the second keying feature comprises a plurality of straight portions along an otherwise curved perimeter at the trailing end of the plug.

9. A closure for a collapsible ink supply container having a spout affixed thereto, the closure comprising:

a plug having an outside surface conforming generally to an inside surface of the spout;

a ridge on the outside surface of the plug, the ridge configured to interfere with the spout when the plug is inserted into and removed from the spout such that the interference between the spout and the ridge resists but does not prevent inserting the plug into the spout and removing the plug from the spout;

a lip on the outside surface of the plug, the lip spaced apart from the ridge lengthwise along the outside surface, and the lip configured to interfere with the spout to resist but not prevent inserting the plug into the spout and catch on the spout to prevent removing the plug from the spout once the plug is inserted fully in the spout;

a conduit extending lengthwise through the plug, the conduit having an inlet through which ink in the container may flow into the conduit when the plug is inserted in the spout and an outlet from which ink may flow out of the conduit;

protrusions around the inlet configured to prevent the container from collapsing on to and closing the inlet; and a septum sealing the outlet.

10. The closure of claim 9, further comprising a seal around the outside surface of the plug, discrete from the ridge and the lip, configured to prevent ink in the container from passing between the spout and the plug when the plug is inserted in the spout.

11. The closure of claim 9, further comprising:

a first keying feature on the plug corresponding to a first keying feature in a receptacle for receiving the plug, the first keying feature configured to correctly align the plug with the receptacle; and a second keying feature on the plug corresponding to a second keying feature in the receptacle, the second keying feature configured to prevent the plug from being received in an incompatible receptacle.

12. The closure of claim 9, wherein the protrusions comprise a plurality of ridges around the inlet on a face facing an interior of the container when the plug is inserted in the container.

13. The closure of claim 12, wherein the ridges on the face radiate out from the inlet in a spoke-like pattern.

14. An ink supply, comprising:

a container for holding a supply of ink;

a spout affixed to the container;

a plug having:

a leading end and a trailing end relative to an insertion direction of the plug into the spout;

an outside surface extending between the leading end and the trailing end, the outside surface of the plug conforming generally to an inside surface of the spout;

a conduit from the leading end to the trailing end through which ink in the container may flow when the plug is inserted in the spout;

a breachable seal sealing the conduit; and a pocket in the trailing end of the plug configured to house a chip containing information about the container and/or ink in the container; and a receptacle having:

a recessed part for receiving the trailing end of the plug;

an ink inlet in the recessed part configured to breach the breachable seal on the plug when the plug is received in the receptacle;

an electrical contact projecting out for insertion into the pocket on the trailing end of the plug when the plug is received in the receptacle;

an ink outlet connected to the ink inlet; and a releasable latch configured to releasably hold the plug in the receptacle.

15. The ink supply of claim 14, wherein the container comprises a collapsible container and the leading end of the plug includes a face facing an interior of the container when the plug is inserted in the spout, the face having a plurality of ridges thereon near an opening to the conduit.

16. The ink supply of claim 14, wherein:

the outside surface of the plug has a ridge thereon configured to interfere with a lip on the spout when the plug is inserted into and removed from the spout such that the interference between the lip on the spout and the ridge on the plug resists but does not prevent inserting the plug into the spout and removing the plug from the spout; and the outside surface of the plug has a lip thereon spaced apart lengthwise from the ridge and configured to interfere with the lip on the spout as the plug is pushed in to the spout to resist but not prevent inserting the plug into the spout and to catch on the lip on the spout as the plug is pulled out of the spout to prevent removing the plug from the spout.

17. The ink supply of claim 14, further comprising:

a first keying feature on the trailing end of the plug and a corresponding first keying feature in the receptacle, the first keying features configured to correctly align the plug with the receptacle; and a second keying feature on the trailing end of the plug and a corresponding second keying feature in the receptacle, the second keying features configured to prevent the receptacle from receiving an incompatible plug.

18. The ink supply of claim 16, further comprising a seal around the outside surface of the plug configured to prevent ink in the container from passing between the inside surface of the spout and the outside surface of the plug when the plug is inserted in the spout.

19. The ink supply of claim 17, wherein the first keying feature on the plug comprises a plurality of posts projecting out at the trailing end of the plug and the first keying feature on the receptacle comprises a corresponding plurality of holes in the receptacle for receiving the posts.

20. The ink supply of claim 19, wherein the second keying feature on the plug comprises a plurality of straight portions along an otherwise curved perimeter at the trailing end of the plug and the second keying feature on the receptacle comprises a corresponding plurality of straight portions along an otherwise curved perimeter at the recessed part of the receptacle.

21. A closure for a supply container, comprising:

a spout affixed to the container;

a plug configured to plug the spout in a partially inserted position at which the plug cooperates with the spout to provide a first degree of resistance against removal of the plug from the spout and to plug the spout in a fully inserted position at which the plug cooperates with the spout to provide a second degree of resistance against removal of the plug from the spout greater than the first degree of resistance;

an opening in the plug through which material in the container may flow when the plug is inserted into the spout; and a breachable seal sealing the opening;

wherein the container comprises a collapsible container and the plug includes a spacer configured to prevent the container from collapsing on to and closing the opening and wherein the spacer comprises a plurality of ridges near the opening on a face facing an interior of the container when the plug is inserted in the container.

* * * * *